United States Patent [19]

Deaton

[11] 3,969,870

[45] July 20, 1976

[54] BAFFLE ASSEMBLY AND ILLUMINATOR GRID

[76] Inventor: Charles U. Deaton, Genesee Mountain, Golden, Colo. 80401

[22] Filed: Mar. 17, 1975

[21] Appl. No.: 558,641

[52] U.S. Cl. ..... 52/645; 52/28; 52/664; 52/669; 240/78 LK

[51] Int. Cl.[2] ..... E04H 12/18

[58] Field of Search ..... 160/164, 136, 84 V, 160/229 R, 234, 235; 240/78 LD, 9 R, 78 R, 46.07, 46.09, 46.27, 78 LK; 52/645, 664, 473, 28, 484, 666, 758 A, 39, 109, 665, 668, 646

[56] References Cited

UNITED STATES PATENTS

| | | | |
|---|---|---|---|
| 2,912,910 | 11/1959 | Wilson et al. | 52/646 X |
| 2,939,543 | 6/1960 | Zingone | 52/664 X |
| 3,083,761 | 4/1963 | Attwood | 160/136 |
| 3,798,446 | 3/1974 | Deaton | 52/28 X |

*Primary Examiner*—Ernest R. Purser
*Assistant Examiner*—Carl D. Friedman
*Attorney, Agent, or Firm*—Horace B. Van Valkenburgh; Frank C. Lowe

[57] ABSTRACT

A baffle assembly comprises a series of cross baffles which are pivotally connected, in depending relation, to a pair of longitudinal baffles, so that the longitudinal baffles and cross baffles may be folded together and thereby reduce considerably the shipping and storage space. Between spaced pairs of such baffle assemblies, a series of transverse baffles may be pivotally connected to angles which rest on outwardly extending ledges of the adjacent baffle assemblies. The space between adjacent baffle assemblies may be covered by lateral extensions of the cross baffles pivoted to the longitudinal baffles.

12 Claims, 17 Drawing Figures

BAFFLE ASSEMBLY AND ILLUMINATOR GRID

This invention relates to light shielding, light baffling or light diffusion illuminator grids or structures which may not only mask the glare of an illuminator from direct view, but also may contribute to the decor of a room or area in which used.

One previous typical illuminator grid has been the so-called "egg crate" type which consisted of a series of parallel baffles extending in one direction and an intersecting series of parallel baffles extending in a perpendicular direction, with the spaces between the intersecting baffles being cubical. In variations of this construction, the cubical spaces may be enlarged in either direction to form rectangular spaces. More recent developments in the illuminator grid art have been my U.S. Pat. Nos. 2,870,883 issued Jan. 27, 1959, 3,006,019 issued Oct. 31, 1961, 3,008,025 issued Apr. 30, 1963, and 3,774,024 issued Nov. 20, 1973. In these illuminator grids, perpendicular rows of ight ray baffles are supported in an alternating orthogonal pattern. In each of these types of baffles, the desired interception of light is that the light emanating from illumination means above the baffle is intercepted at a 45°angle, so that a person ordinarily moving under the baffle would not see the illuminator directly, except when looking upwardly at an angle greatr than 45° to the horizontal. In each of the above types, the baffles have been assembled in the finished condition and thus occupy a considerable space in comparison with the weight, thus increasing the cost of both shipment and storage.

The present invention reduces the space occupied by a baffle assembly, as for shipping and storage, by a baffle assembly which may be folded to a collapsed position in which the space occupied by the collapsed baffle is much more representative of its weight. This is accomplished by pivotally mounting a series of transverse baffles on a pair of longitudinal plates or a pair of carriers for a series of spaced transverse baffles, the pivotal connection permitting the two longitudinal baffles or the two supports for a series of transverse baffles to be collapsed toward each other, with the transverse baffles pivoting to a position collapsed against the respective longitudinal baffles or longitudinal supports.

Another feature is that the baffle assemblies are made in a form that can be easily assembled, are simple to install or to remove for cleaning or for servicing the light source, and provide a construction that may be varied in its manufacture as to material, color and shape. A further feature is that the construction will appear, when installed, to be continuous and unbroken in appearance of its design and pattern within the borders of the ceiling area.

Numerous variations may be made in the baffle assemblies of this invention to produce essentially either an "egg crate" construction or baffles in an orthogonal pattern, as well as additional variations.

The foregoing features of the baffle assembly of this invention, as well as additional features, will become apparent from the description which follows, taken in conjunction with the accompanying drawings, in which.

Figure 1:
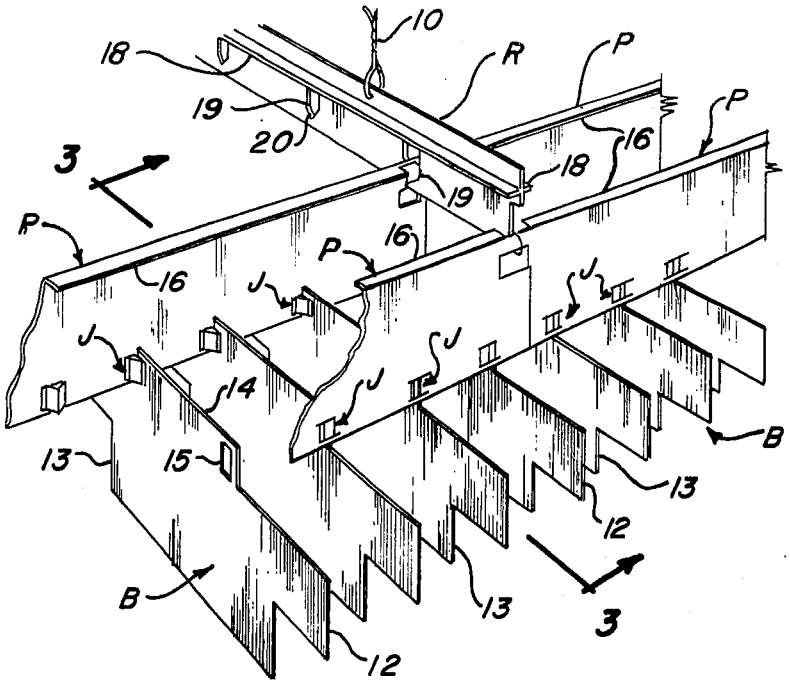
FIG. 1 is a fragmentary perspective view showing the intersection of two baffle assemblies of this invention and the supporting structure therefor.
Figure 2:
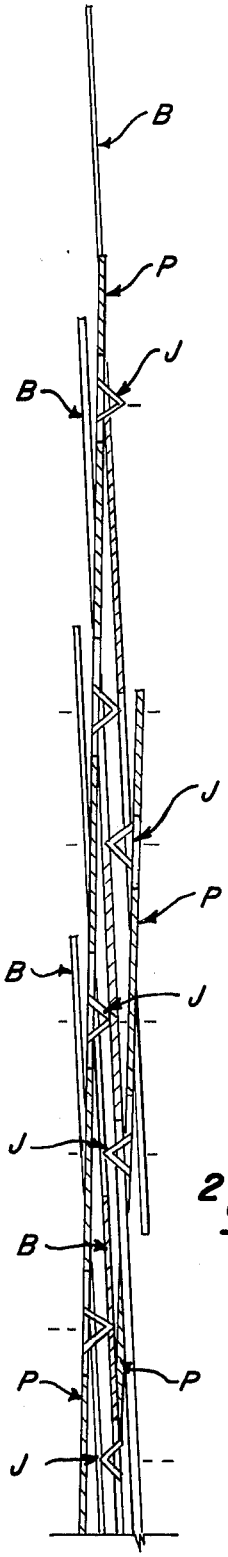
FIG. 2 is a horizontal section taken at the position of line 2—2 of FIG. 3, but showing the baffle assembly in folded position for shipment or storage.

The baffle assembly illustrated in FIGS. 1–5 includes an upper supporting rail R which is suspended from the ceiling by a series of wires 10 connected at holes 11 and, as shown, forming a support for a series of pairs of upper or longitudinal baffle plates P, from which depend a series of transverse baffles B. The transverse baffles B are connected to the longitudinal or upper baffle plates P through a series of pivot joints J, the preferred construction of which will be described later. As illustrated in FIG. 2, a pair of upper baffle plates P, along with the transverse baffles B attached thereto, may be moved to a collapsed position, with the transverse baffles B folded in between and against the baffle plates P, so that only a small fraction of the space occupied by the baffle assembly in unfolded position will be occupied by the collapsed assembly. As will be evident, the reduction in the size of the assembly effects a corresponding reduction in the cost of either shipping or storing the baffle assemblies. Thus, the baffle assembly, consisting of a pair of upper baffle plates P and a series of pivotally connected, transverse baffle B, need only to be shifted to the unfolded position of the parts for connection to the appropriate support rails R. The height of longitudinal baffles P, in proportion to the distance between them, as well as the height of baffles B, in proportion to the distance between them, are such that the degree of light intercepted is similar to that usually provided for egg crate type baffles, i.e. interception of light up to an angle of 45° to the horizontal.

Each baffle B is provided with a lateral planar extension 12 formed through a rectangular cutout 13 at each lower corner. The lateral planar extensions are interdigitated, as in FIG. 4, with the planar extensions of adjacent baffles overlapping, as in FIG. 3. To accommodate the pivot joints J, each baffle has a central upward extension 14 which fits between the spaced baffle plates P and which is provided with a rectangular slot 15, as in FIG. 1, adjacent each end thereof.

Figure 3:
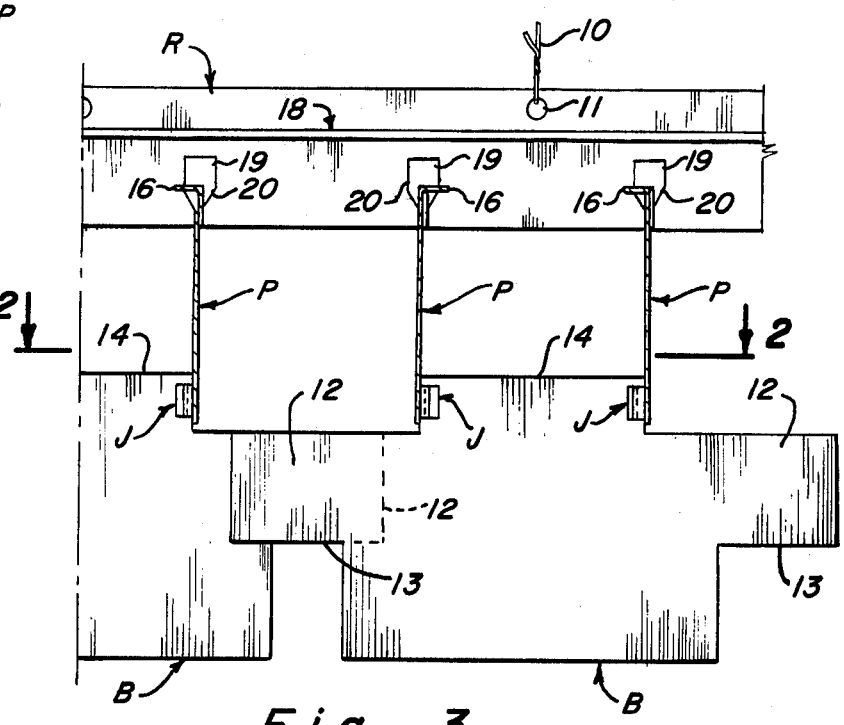
FIG. 3 is a vertical section taken along line 3—3 of FIG. 1.

Each upper baffle plate P is reinforced by an inwardly extending top flange 16, with the flanges of the two baffle plates of one assembly facing toward each other, as in FIG. 3, or facing away from wach other, as desired. The supporting rail R is provided with a pair of lateral flanges 18 extending to each side, to form a cross-shaped structure, as in FIG. 5. Below the flanges is a slot 19 which is rectangular, except for a V-shaped base 20, as in FIG. 3. Each end of each plate P is provided with a neck 21 and a hook 22, as in FIG. 5, adapted to be inserted in the slot 19, with the slot between neck 21 and hook 22 engaging material below the slot 19, as in FIG. 5. The reinforcing flange 16 may be discontinued at the inner edge of neck 21, so that the hooks 22 of longitudinally adjacent baffles P, essentially in alignment, may both enter the slot 19 without interference from the other. In order to provide an overlap of the longitudinal upper baffle plates P, a longitudinal extension 23 is provided at one end, as in FIG. 5. The lateral flanges 18 of the support rails R may serve to support a series of light diffusion plates 24, as in FIG. 5, extending between adjacent rails R and diffusing light, so that an individual lamp or the like will not be visible.

Figure 6:
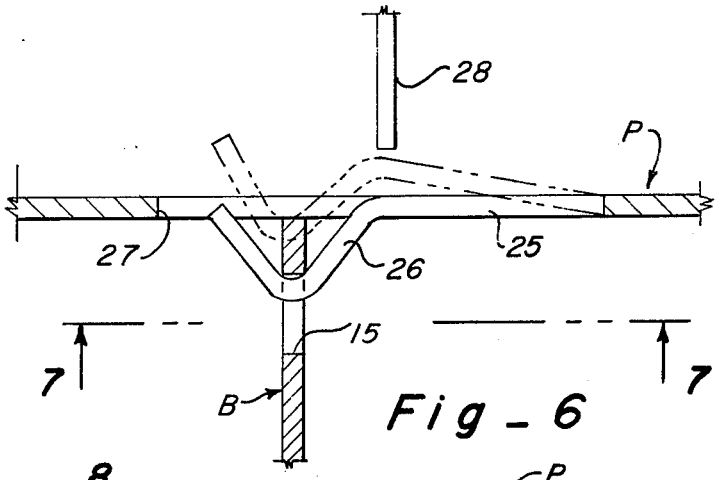
FIG. 6 is a horizontal section of a joint between a lower baffle and an upper baffle or support therefor, or an enlarged scale and taken along line 6—6 of FIG. 7.
Figure 7:
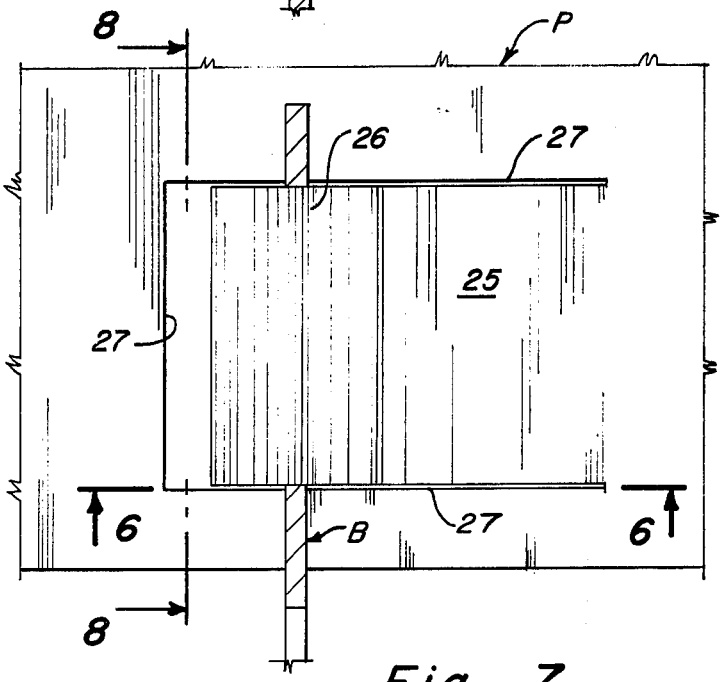
FIG. 7 is a vertical section taken along line 7—7 of FIG. 6.
Figure 8:
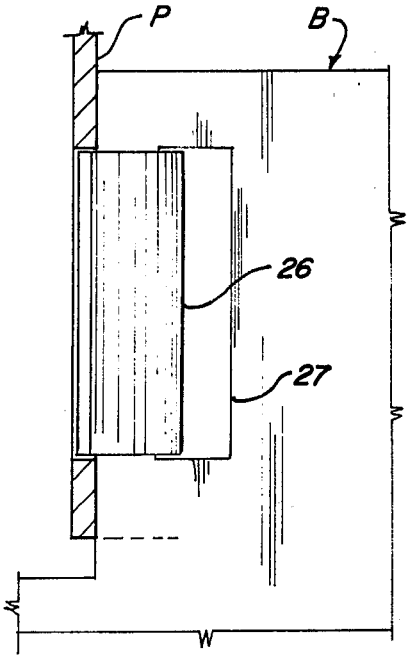
FIG. 8 is a transverse vertical section taken along line 8—8 of FIG. 7.

Each joint J, as in FIGS. 6–8, may include, in addition to the previously mentioned slots 15 in the baffles B, a tongue 25 provided with a V-shaped end 26 made by a three sided slot 27 being punched from the baffle plate P and the V-shaped end 26 simultaneously formed, or later formed. The material of plate P may be steel or other material having a sufficient resilience that the tongue 25, when set after punching, will occupy the broken line position of FIG. 6. Fo9r pivotal attachment of the respective baffle B, a tool 28 may be utilized in flexing the tongue, so that the end of the tongue will clear the near side of baffle plate P a sufficient distance to permit the tongue to enter the slot 15. The tongue 25 may then be released, for engagement of the V-shaped end 26 with the edge of slot 15. Each rail R may be of aluminum or steel, while cross baffles B may be made of aluminum, which may be colored to provide an esthetic color pattern. Baffle plate P may also be colored, as desired.

Figure 4:
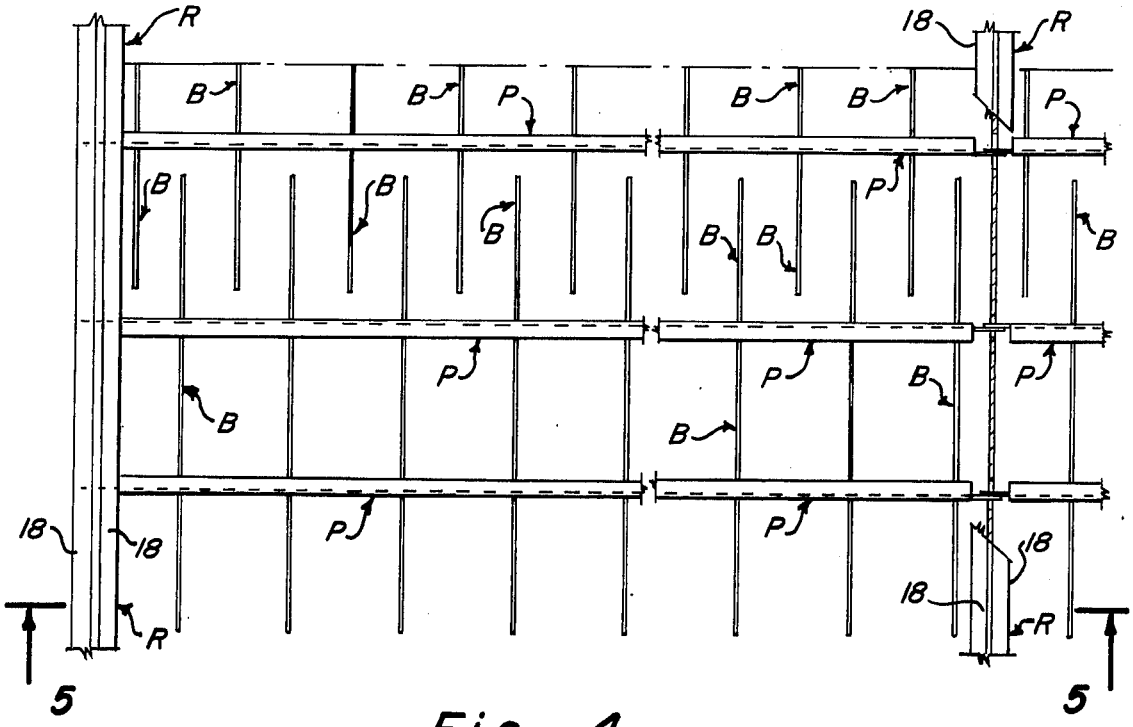
FIG. 4 is a top plan view of the baffle assemblies of FIG. 1, showing also a portion of other baffle assemblies which are interdigitated therewith.
Figure 5:
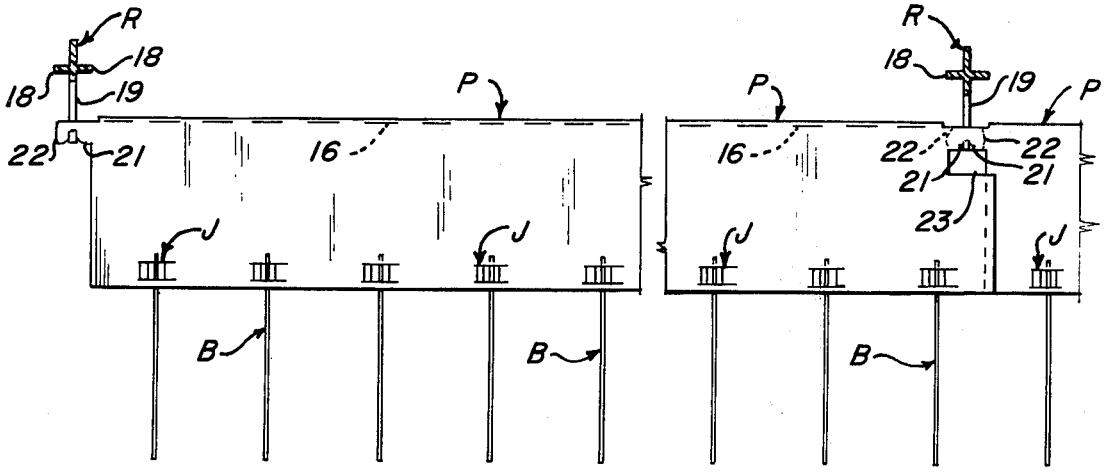
FIG. 5 is a vertical section taken along line 5—5 of FIG. 4.

The baffle assemblies, as in FIG. 4, include a baffle B spaced a shorter distance from one end of plate P and a baffle B spaced a greater distance from the opposite end, so that the baffle assemblies may be arranged alternately, and each baffle of one assembly, which is interdigitated with the adjacent assembly, will be equally spaced from the baffles of the latter.

Figure 9:
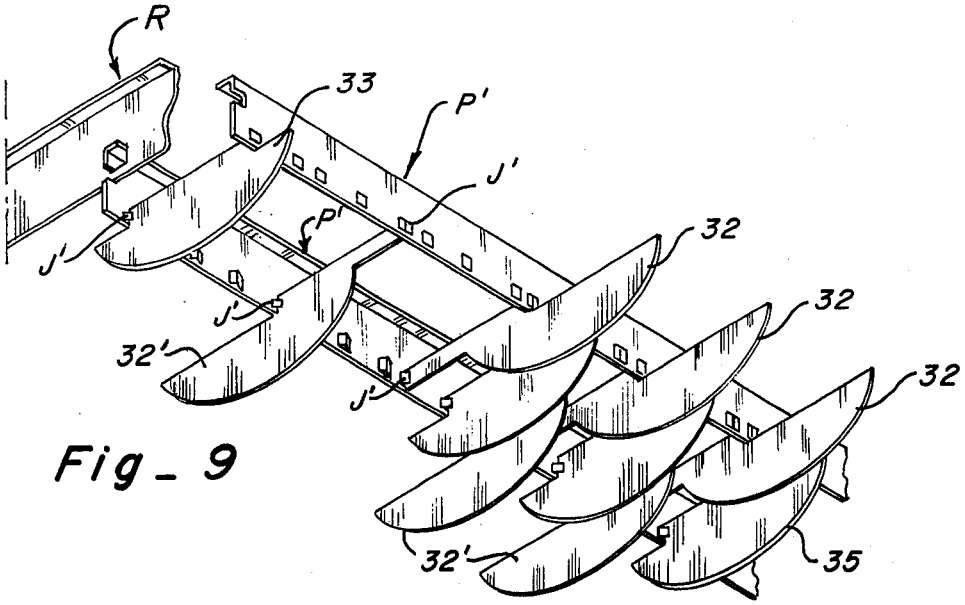
FIG. 9 is a fragmentary perspective view, looking upwardly, of an alternative baffle assembly with certain of the baffles omitted for clarity or illustration.

In the alternative baffle arrangement of FIG. 9. a series of offset baffles 32 and 32' extend alternately to one side and the other side of a pair of upper baffle plates P', while a series of interspaced center baffles 33 extend to a point greater than one-half the distance to a plate P of the adjacent baffle assembly. The baffles are spaced apart longitudinally for unequal distances, with the distance between two adjacent but oppositely directed baffles 32 being, for instance, one-fourth of the distance between a baffle 32 and a baffle 33. This provides a staggering of the baffles and a desirable esthetic effect. Each baffle 32 is adjacent an offset type of baffle, i.e. a baffle 32 extending toward the next baffle assembly will be adjacent a baffle 32 of the next assembly, but extending in the same direction. Similarly, the baffles 33 of the two assemblies are adjacent each other. One end baffle of each assembly, such as a baffle 33, is spaced from the plate P a different distance than the baffle at the opposite end, such as a baffle 33, so that the assemblies may be installed in alternating positions transvesely of the grid. As will be evident, the same pattern of baffles may be incorporated in all of the baffle assemblies and the assemblies merely secured in position to adjacent assemblies, with baffle plates *P* connected to supporting rails corresponding to rails R of FIGS. 1–5. The baffle assemblies may also be folded to a collapsed position occupying a fraction of the space in unfolded position.

Figure 11:
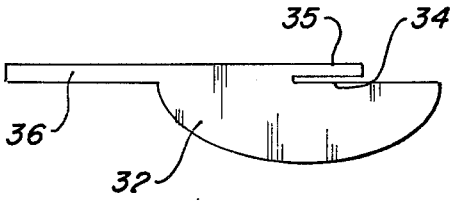
FIG. 11 is a front elevation, on a reduced scale, of an individual baffle which may be utilized in the baffle assembly of FIG. 9.
Figure 12:
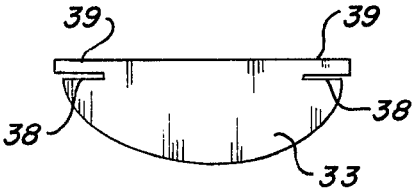
FIG. 12 is a front elevation, on a reduced scale, of an individual baffle which may also be utilized in the baffle assembly of FIG. 9.
Figure 10:
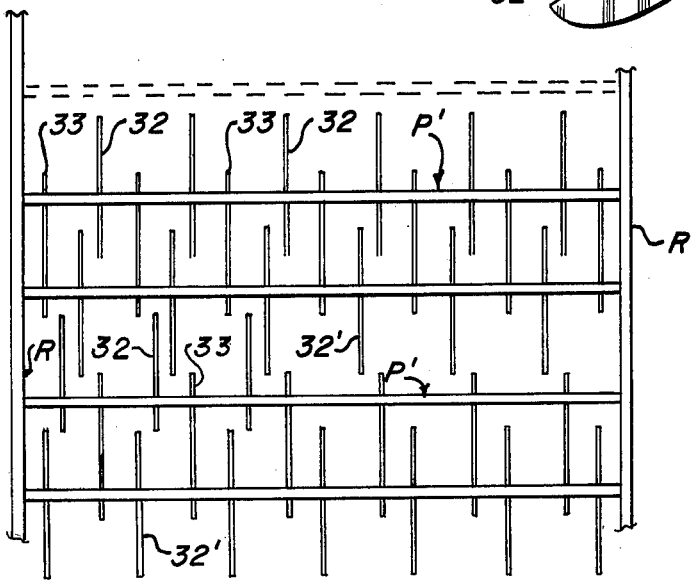
FIG. 10 is a partially diagrammatic top plan view of the interdigitated baffle assemblies of FIG. 9.

The offset baffles 32, as in FIG. 10, are rounded on the bottom, with a slit 34 and stem 35 at one corner, which is attached to the corresponding baffle plate P' and a stem 36 at the opposite corner which is attached to the opposite baffle plate P. The center baffles 33, as in FIG. 11, are also rounded on the bottom, but this arc is centered laterally of the baffle. This baffle is provided with a slit 38 and stem 39 at each upper corner, with the latter being attached to the opposite baffle plate P'.

Figure 13:
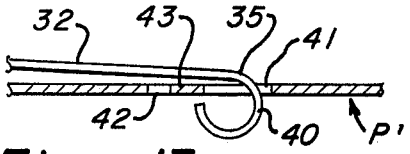
FIG. 13 is a horizontal section, taken through an arcuate tongue of a lower baffle and illustrates a step in producing an alternative joint by which a transverse baffle may be pivotally attached to a longitudinal baffle.
Figure 14:
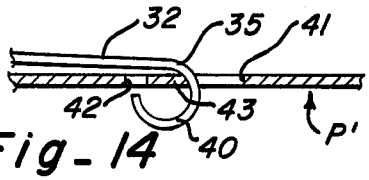
FIG. 14 is a section similar to FIG. 13 but illustrates a further step in the pivotal attachment.
Figure 15:
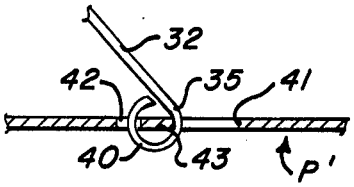
FIG. 15 is a section similar to FIG. 13 but illustrates a final step in the pivotal attachment.

The cross baffles 32, 32' and 33 may be pivotally attached to the upper longitudinal baffle plates P' by a joint J' which, as in FIGS. 13–15, includes a curl 40 formed from stem 35 of baffle 32, or in a similar manner from stem 36 of baffle 32 or each stem 39 of baffle 33. Curl 40 is initially partially open, so that it may be inserted bodily into a slot 41 in plate P' which is also provided with a spaced but narrower slot 41 and a post 43 between the slots. After insertion into slot 41, the baffle 32 is moved longitudinally to the position of FIG. 14, in which the end of curl 40 is opposite slot 42. Then the curl is closed, as in FIG. 15, so as to encircle post 43 and thereby pivotally attach the cross baffle to the longitudinal baffle or a support for the cross baffle.

Figure 16:
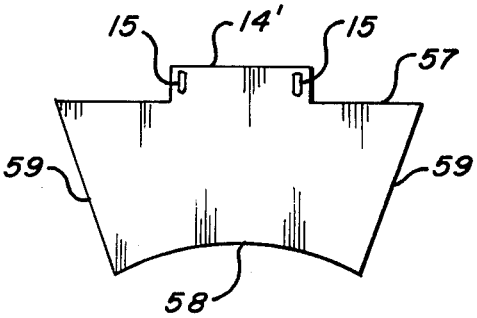
FIG. 16 is a front elevation of an alternative individual baffle which may be used in the above baffle assemblies, and particularly in lieu of the baffle of FIG. 12.

The alternative baffle plate 57, as shown in FIG. 16, is similar to the baffles B of FIG. 1 in that it may be substituted for such baffles, thus including a central upward extension 14' adapted to extend up between a pair of baffle plates P and pivotally attached thereto, as through rectangular slots 15. The bottom edge 58 of the baffle 57 is concave about a central axis, while each end 59 slopes downwardly and inwardly. The baffles 57 may be placed in interdigitated relationship with the baffles of the adjacent baffle assembly, while any of the baffles 32, 33 may be modified to have a concave bottom and sloping ends.

Figure 17:
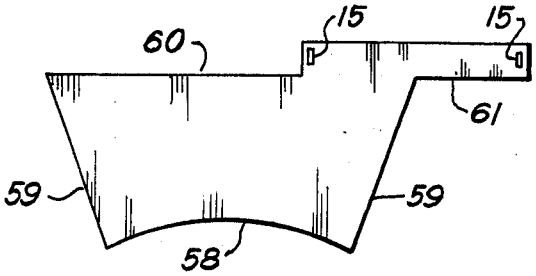
FIG.17 is a front elevation of another alternative baffle which may be used in the above baffle assemblies and particularly in lieu of the baffle of FIG. 11.

The alternative baffle 60 of FIG. 17 is similar to the baffles 32 of FIG. 11 but has a concave bottom edge 58 and downwardly and inwardly sloping side edges 59. Baffle 60 is also provided with a lateral stem 61 and slots 15 for pivotal attachment in a baffle assembly, as through a joint J. As will be evident, for pivotal attachment by a joint J', for instance, baffle 60 may be provided with stems corresponding to stems 35 and 36 of FIG. 11.

All of the baffle assemblies previously described are simple to install or to remove for cleaning or for servicing the light source, since the intersections of the hooks 22 of the longitudinal baffles with the slots 19 of the supporting rails are readily placed in position or removed.

Although several preferred embodiments have been illustrated and described, as well as variations thereof, it will be understood that other embodiments may exist and that various other changes may be made, all without departing from the spirit and scope of this invention.

What is claimed is:

1. A baffle assembly for an illuminator grid adapted to be supported below a source of light, comprising:

a normally parallel pair of primary baffle plates;

a series of secondary baffles normally in a generally perpendicular relation to said primary baffle plates;

said secondary baffles extending between said baffle plates, at least a substantial portion of each secondary baffle being below said plates, at least a portion of said secondary baffles extending laterally beneath and beyond the corresponding baffle plate at one side and at least a portion of said secondary baffles extending laterally beneath and beyond the opposite baffle plate; and pivotal connections between said secondary baffles and said pair of baffle plates, whereby said baffle plates may be moved toward each other and said secondary baffles will pivot into an overlapping relation with the respective baffle plates at opposite sides thereof.

2. An illuminator grid comprising a plurality of baffle assemblies as defined in claim 1, whrein:

said assemblies are disposed in side by side relation with secondary baffles which extend laterally beyond a longitudinal plate of one assembly, being longitudinally interspaced with the baffles of an adjacent assembly which extend laterally beyond the adjacent longitudinal plate thereof.

3. An illuminator grid as defined in claim 2 including a plurality of sets of primary baffle plates and secondary baffles, wherein:

each of said secondary baffles extends laterally beyond the corresponding longitudinal plate as a lateral planar extension; and the lateral extensions of one set of secondary baffles are interdigitated with the lateral extensions of the adjacent set of baffles.

4. An illuminator grid as defined in claim 3, wherein:

said secondary baffles are provided with a rectangular notch at each lower corner.

5. A baffle assembly as defined in claim 1, wherein:

said secondary baffles are pivotally connected to said supporting plates by an offset finger struck from said supporting plates and engaging a slot in the corresponding secondary baffle.

6. A baffle assembly as defined in claim 1, wherein:

said secondary baffles are pivotally connected to said supporting plates by an arcuate curl of a baffle surrounding a post disposed between a pair of apertures in said supporting plate.

7. An illuminator grid comprising a series of baffle assemblies as defined in claim 1, wherein:

a support rail for each end of each primary baffle plate is disposed above the ends of said primary baffle plate; and a hook at the uppr end of a primary baffle plate engages a slot in the corresponding rail, said slots in said rails being generally rectangular with an inverted V-shaped base.

8. An illuminator grid comprising a plurality of baffle assemblies as defined in claim 1, wherein:

said primary baffle plates of said assemblies are disposed in longitudinal rows, with the lateral distance between the primary baffle plates of laterally adjacent assemblies being substantially the same as the lateral distance between the primary baffle plates of the individual assemblies; and said secondary baffles which extend laterally beyond a longitudinal plate of one baffle assembly are interspaced with baffles of the adjacent assembly which extend laterally beyond the adjacent longitudinal support.

9. An illuminator grid as defined in claim 8, wherein:

the space between primary baffle plates of laterally adjacent assemblies is occupied by lateral portions of said secondary baffles, in interdigitated and overlapping relation.

10. An illuminator grid, as defined in claim 8, wherein:

each of said secondary baffles extends laterally beyond each longitudinal plate.

11. An illuminator grid as defined in claim 8, wherein:

the spaces between primary baffle plates of laterally adjacent assemblies is occupied at least in part by secondary baffles extending alternately to opposite sides of a baffle assembly.

12. An illuminator grid as defined in claim 11, wherein:

secondary baffles extending to both sides of the respective baffle assembly are interposed between pairs of secondary baffles extending alternately to opposite sides.

* * * * *